US010105814B2

(12) United States Patent
Sawada et al.

(10) Patent No.: US 10,105,814 B2
(45) Date of Patent: Oct. 23, 2018

(54) POLISHING SHEET, POLISHING TOOL AND POLISHING METHOD

(71) Applicants: Kiyotaka Sawada, Kanagawa (JP); Jun Zhang, Kanagawa (JP); Hidekazu Masuo, Kanagawa (JP); Wataru Kikuta, Tokyo (JP); Tatsuya Tanaka, Kanagawa (JP); Tomihiro Takahashi, Kanagawa (JP); Tsuyoshi Hashiyada, Tokyo (JP); Yutaro Hoshino, Kanagawa (JP); Kyohta Koetsuka, Kanagawa (JP)

(72) Inventors: Kiyotaka Sawada, Kanagawa (JP); Jun Zhang, Kanagawa (JP); Hidekazu Masuo, Kanagawa (JP); Wataru Kikuta, Tokyo (JP); Tatsuya Tanaka, Kanagawa (JP); Tomihiro Takahashi, Kanagawa (JP); Tsuyoshi Hashiyada, Tokyo (JP); Yutaro Hoshino, Kanagawa (JP); Kyohta Koetsuka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 107 days.

(21) Appl. No.: 15/007,792

(22) Filed: Jan. 27, 2016

(65) Prior Publication Data

US 2016/0221147 A1 Aug. 4, 2016

(30) Foreign Application Priority Data

Jan. 30, 2015 (JP) ..... 2015-017162

(51) Int. Cl.

*B24B 37/24* (2012.01)
*B24B 37/26* (2012.01)
*B24D 11/04* (2006.01)

(52) U.S. Cl.

CPC ..... *B24B 37/24* (2013.01); *B24B 37/245* (2013.01); *B24B 37/26* (2013.01); *B24D 11/04* (2013.01); *B24D 2203/00* (2013.01)

(58) Field of Classification Search

CPC ..... B24D 7/14; B24D 11/02; B24D 11/04; B24D 2203/00; B24B 37/24; B24B 37/245; B24B 37/26

See application file for complete search history.

(56) References Cited

U.S. PATENT DOCUMENTS 5,190,568 A * 3/1993 Tselesin ..... B23D 61/021 451/527
5,681,362 A * 10/1997 Wiand ..... B24B 7/22 51/293

(Continued)

FOREIGN PATENT DOCUMENTS

JP 2003-105324 4/2003
JP 2004-82323 3/2004

(Continued)

*Primary Examiner* — Timothy V Eley
(74) *Attorney, Agent, or Firm* — Cooper & Dunham LLP

(57) ABSTRACT

A polishing sheet includes a sheet including one side having a surface, a plurality of convex portions provided to project from the surface of the one side of the sheet, a plurality of first abrasive grains provided on an upper surface of each of the convex portions, and a plurality of second abrasive grains provided on the surface of the sheet. The second abrasive grains each have hardness higher than that of the first abrasive grains.

8 Claims, 7 Drawing Sheets

(56) References Cited

U.S. PATENT DOCUMENTS 5,782,682 A * 7/1998 Han ..... B24B 7/22 451/527
6,200,360 B1 * 3/2001 Imai ..... B24D 3/06 428/143
6,332,832 B1 * 12/2001 Suzuki ..... B24B 37/26 451/41
6,478,831 B2 * 11/2002 Tselesin ..... B23D 61/021 51/293
7,169,029 B2 * 1/2007 Petersen ..... B24D 11/005 451/523
7,235,114 B1 * 6/2007 Minick ..... B24D 3/004 451/533
7,399,516 B2 * 7/2008 Basol ..... B23H 5/08 204/224 M
8,062,102 B2 * 11/2011 Park ..... B24B 37/22 451/527
9,393,673 B2 * 7/2016 Eilers ..... B24D 3/28
9,440,331 B2 * 9/2016 Sawada ..... B24D 11/00
2004/0040216 A1 3/2004 Endoh et al.
2007/0062124 A1 3/2007 Endoh et al.
2010/0003904 A1 * 1/2010 Duescher ..... B24B 37/14 451/259
2012/0302148 A1 11/2012 Bajaj et al.
2015/0056900 A1 2/2015 Bajaj et al.
2015/0057209 A1 2/2015 Sawada et al.
2015/0126098 A1 * 5/2015 Eilers ..... B24D 3/28 451/529
2015/0165592 A1 * 6/2015 Sawada ..... B24D 11/00 451/527
2016/0151888 A1 * 6/2016 Gottardelli ..... B24D 3/28 51/298

FOREIGN PATENT DOCUMENTS

JP 2004-106121 4/2004
JP 2010-76068 4/2010
JP 2011-231135 11/2011
JP 2014-515319 6/2014
JP 2015-112709 6/2015

* cited by examiner

POLISHING SHEET, POLISHING TOOL AND POLISHING METHOD

CROSS-REFERENCE TO RELATED APPLICATION

This application is based upon and claims the benefit of priority to Japanese Patent Application No. 2015-017162, filed on Jan. 30, 2015, the entire disclosures of which are incorporated herein by reference.

BACKGROUND

Technical Field

The present invention relates to a polishing sheet, a polishing tool, and a polishing method.

Description of Related Art

Water scale is deposited on surfaces of mirrors or glasses provided on bath rooms or washrooms, and kitchen utensils, cocks of water supplies, bathtubs, sinks and so on due to environment where water is used. In particular, the water scale deposited on the surface of the mirror or the glass contains calcium carbonate or silica as a main component and is very rigid and hard to remove. In particular, when the water scale is thick and sticks on the glass to become squamous state, there is a case that it is difficult to perfectly rub off the water scale from the glass by a sponge.

It is attempted that the water scale is removed from the surface of the mirror or the glass by using a sand paper on the market. However, a material of abrasive grain of the sand paper is usually alumina, silica, zirconia, and so on. Accordingly, the abrasive grain of the sand paper has hardness higher than that of the mirror or glass. As a result, the water scale can be removed, but there is a defect that damages (occurrence of a scar and so on) a surface of the mirror or the glass.

A technology disclosed in JP2003-105324A relates to a polishing tool for glass, or silicon wafer. FIG. 12 illustrates an example of the conventional polishing tool as a model. In the example, abrasive grains 100 are arranged on one side of a sheet-shaped base 103 by a binder layer 102.

The removal of the water scale on the surface of the mirror or the glass was attempted by using the conventional polishing sheet. However, in particular, the squamous water scale was not removed even if a very large force was applied to polish (wash) the water scale, therefor it was not possible to obtain sufficient effect.

SUMMARY

The present invention is made in view of the above and an object of the present invention is to provide a polishing sheet, a polishing tool, and a polishing method capable of rapidly removing water scale, in particular, squamous water scale which is adhered to a mirror or glass and very hard to remove by the conventional polishing sheet or polishing tool while reducing a risk of damaging the mirror or the glass.

To accomplish the above object, a polishing sheet includes a sheet having one side having a surface, a plurality of convex portions provided to project from the surface of the one side of the sheet, a plurality of first abrasive grains provided on an upper surface of each of the convex portions, and a plurality of second abrasive grains provided on the surface of the sheet. The second abrasive grains each have hardness higher than that of the first abrasive grains.

DETAILED DESCRIPTION

Embodiments according to the present invention will be described with reference to the accompanying drawings.

A first embodiment is first described.

(First Abrasive Grain)

Figure 1A:
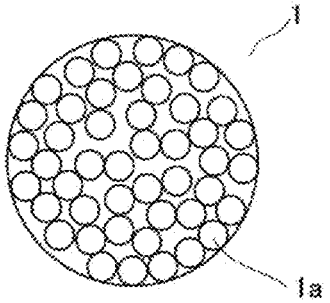
FIG. 1A is a schematic diagram showing a model of an abrasive grain composed of a particulate porous body in which primary particles are partially combined to each other and combined to have gaps, in a first embodiment according to the present invention.

FIG. 1A illustrates a model of an abrasive grain 1 which is configured by a particulate porous body (hereinafter referred to as particulate porous body) and is used as a first abrasive grain in the first embodiment. The particulate porous body is configured in a state where primary particles 1*a* are partially combined to each other and combined to have gaps formed among the primary particles 1*a*. The primary particles 1*a* are formed by, for example, a hard inorganic material in the first embodiment.

Figure 1B:
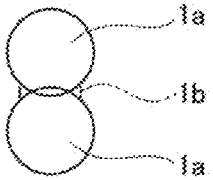
FIG. 1B is an explanatory view showing a state where a neck is formed at a combining point between the primary particles.

The particulate porous body can be obtained by executing heating processing of secondary particles in which the primary particles are formed to cohere with a temperature where one sheet hyperboloid shaped (drum-shaped) necks 1*b* are formed at combining points among the primary particles 1*a* (see FIG. 1B). Such a particulate porous body can be produced by a method disclosed in JP2003-105324A, for example.

As the primary particles 1*a*, for example, zirconium oxide, cerium oxide (ceria), silica, alumina, titanium oxide, or a mixture thereof can be used. The particulate porous body made of each of these materials forms the abrasive grain having a high polishing effect or high washing effect, because each of the materials has a high hardness.

In the first embodiment, the particulate porous body obtained by using the primary particles made of zirconium oxide (zirconia), by adding water in the primary particles to form slurry, thereafter by forming the secondary particles by a spray dryer method, and by executing heating processing is used as the first grain. In executing the heating processing, a processing temperature and a processing time are set such that a combining force among the primary particles 1*a* is suitable to remove water scale of a scale state. The use of the particulate porous body makes it possible to acquire a polishing surface of a high quality without generation a scar or scratch on a mirror or glass harder than the water scale.

Here, as a result measured by using a laser diffraction-scattering type particle size distribution measuring device LA-920 produced by Horiba Ltd, it was confirmed that a number average particle diameter was 60 μm and the maximum particle diameter was 80 μm.

In the first embodiment, the particulate porous body is used as the first abrasive grain 1, but is not limited to this. If such an abrasive grain has hardness smaller than that of a second abrasive grain as described below, the abrasive grain can be used as the first abrasive grain.

<Second Abrasive Grain>

In the first embodiment, the second abrasive grain having hardness higher than that of the first abrasive grain is used. For example, particles acquired by crushing silicon carbide, zirconium oxide (zirconia), cerium oxide, silica, alumina, titanium oxide, and so on, or a lump of ceramic obtained by sintering or melting a mixture of the these materials at a high temperature by a clasher can be used as the second abrasive grain. Particles acquired by crushing melted ceramic such as white melted alumina and so on can be also used as the second abrasive grain. Further, the foregoing particulate porous body in which the heat processing condition is changed such that the hardness becomes higher can be used as the second abrasive grain. In the first embodiment, the abrasive grain acquired by crushing the white melted alumina is used. A number average particle diameter is 10 μm and the maximum particle diameter is 20 μm of the second abrasive grain.

Here, after comparing the hardness of the particulate porous body with the crushed alumina of material by the Mohs hardness meter, it was confirmed that hardness of the crushed alumina was higher than that of the particulate porous body.

<Polishing Sheet>

In the first embodiment, as a sheet which is a base of a polishing sheet, a sheet provided with convex portions and made of a resin, which is usually referred to as an emboss sheet, is used. Note that, in the first embodiment, the term, "sheet" means including a film having a thickness of 200 μm or less in general.

As materials of the sheet, general resins can be used. For example, polycarbonate, poly ehylenenaphthalate, polypropylene, poly methylmetaacry late, and polyehylene-terephthalate and so on are listed. Of these, polyehylene-terephthalate is preferably used because it has a high mechanical strength and good flexibility.

A thickness of the sheet is suitably selected in consideration of the material of the sheet such that convex portions to be formed are moderately deformed during polishing to have advantageous effects of the abrasive grain 1 shown in the first embodiment. As for the thickness, it is preferable to be, for example, 10 μm or more to 100 μm or less.

Figure 2A:
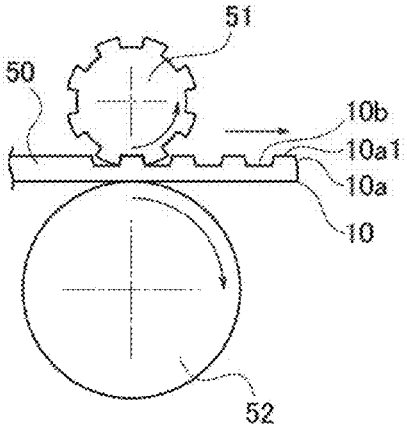
FIG. 2A is an explanatory view showing a model of a method of manufacturing a sheet (base) provided with convex portions, used in a polishing sheet according to the first embodiment.
Figure 2B:
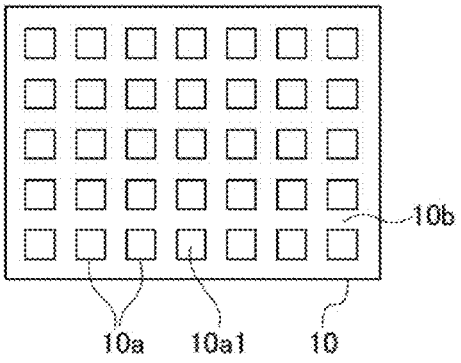
FIG. 2B is a plan view showing the sheet (base) provided with the convex portions.

FIG. 2A illustrates one example of a method of manufacturing the sheet on which a plurality of convex portions is provided on one side of the sheet, and FIG. 2B illustrates a model of the sheet 10 manufactured by the method.

More specifically, the sheet 10 has at the one side (hereinafter referred to as a convex portion forming surface) thereof the plurality of convex portions 10*a* and at the other side (hereinafter referred to as a back surface) thereof a flat surface. Each of the convex portions 10*a* has an upper surface 10*a*1 parallel to a surface 10*b* of the one side of the sheet 10 and is configured to project from the surface 10*b* of the sheet 10, as shown in FIGS. 2A and 2B. The sheet 10 is manufactured by passing, for example, a resin sheet material 50 through a pair of first and second rollers 51 and 52, as shown in FIG. 2A. Here, each of the convex portions 10*a* has, for example, a shape of truncated square pyramid, as shown in FIG. 2A.

The pair of rollers is composed of the first roller 51 having on a circumferential surface thereof convex and concave portions and the second roller 52 having a flat circumferential surface. The first roller 51 is disposed, for example, at an upper side and the second roller 52 at a lower side, as shown in FIG. 2A. Note that it is preferable to heat the resin sheet material 50 and/or at least one of the first and second rollers 51, 52 as needed when passing the resin sheet material through the rollers to form the convex portions 10*a*.

A height (hereinafter referred to as a convex portion height) of the upper surface 10*a*1 of each of the convex portions 10*a* from the surface 10*b* depends on a size of the used abrasive grain, but is usually 10 μm or more to 600 μm or less, preferably 40 μm or more to 200 μm or less.

In the above, although the example where the upper surface 10*a*1 of each convex portion 10*a* is parallel to the surface 10*b* of the sheet 10 is shown, it is not necessary to be parallel. As long as the advantageous effects of the abrasive grain are obtained, the upper surface 10*a*1 may be obliquely provided to the surface 10*b*. In addition, the upper surface 10*a*1 may have a convex surface or concave surface, further may have a curved surface having one or more convex and concave portions.

In the sheet 10 which is the base of the polishing sheet, it is preferable that a total area of the upper surfaces 10*a*1 of the convex portions 10*a* to an entire area (100%) of the sheet 10 is 20% or more to 80% or less, because water scale can be easily removed with a small force. A further preferable range is 40% or more to 60% or less.

In the first embodiment, the sheet (emboss sheet) in which a height of each upper surface 10*a*1 of the convex portions 10*a* is 50 μm and the total area of the upper surfaces 10*a*1 of the convex portions 10*a* to the entire area (100%) of the sheet 10 is 5% was obtained by using a sheet member made of polyehylenenaphthalate and having a thickness of 100 μm, and by executing emboss-processing on the sheet member, as shown in FIG. 2A, In FIG. 2A and FIG. 2B, the example where the surface 10*b* of the sheet 10 among the convex portions 10*a* each having the shape of the truncated square pyramid is arranged to be divided into a checkered pattern. However, the convex portions are not limited to the arrangement. For example, the shape of each of the convex portions may be a circle, an ellipse, a free curve shape, a spiral shape (in this case, it is possible to form the polishing sheet by only one convex portion) or the like, or any combination of them.

Next, one example of a method of arranging and fixing the abrasive grain 1 on the convex portion forming surface of the sheet 10 is described with reference to FIG. 3A to FIG. 3C.

<Application Process 1 (Arrangement of Second Abrasive Grain: See FIG. 3A)>

Figure 3A:
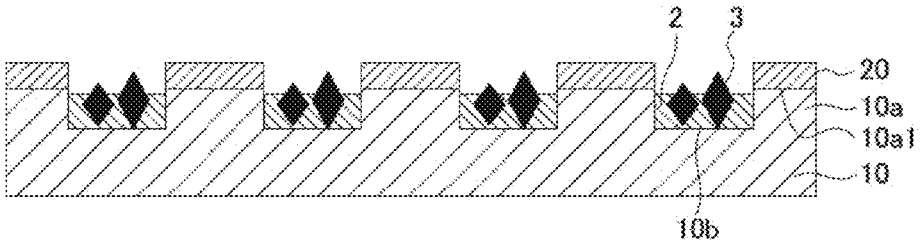
FIG. 3A is a sectional view showing one example of the polishing sheet in which second abrasive grains are provided on the sheet.
Figure 3B:
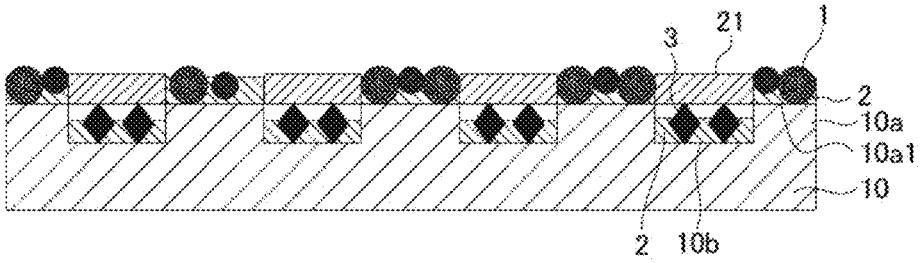
FIG. 3B is a sectional view showing the polishing sheet in which the second abrasive grains and a mask are provided on the sheet.

As shown as a model in FIG. 3A, a mask 20 configured to mask only the upper surfaces 10*a*1 of the convex portions 10*a* is disposed on the sheet 10 on which the convex portions 10*a* each having the upper surface 10*a*1 parallel to the surface 10*b* are provided. Next, a binder is applied on the surface 10*b* of the sheet 10 to form a binder layer 2. Thereafter, a plurality of second abrasive grains 3 is applied on the binder layer 2. The second abrasive grains 3 are held by the binder layer 2, and a part of the second abrasive grains 3 is disposed to project from the binder layer 2. Thereafter, the mask 20 is removed.

Note that such a binder can be applied by a wire bar coater, a die coater, a comma coater, a gravure coater, a knife coater, and so on.

The use of the binder which has excellent adhesive property is required to prevent the abrasive grains or the binder layer itself from peeling from the sheet before anything happens. In addition, in a case where a bath or an exterior mirror or glass is polished, it is necessary for the binder to have water resistance. As such a binder, for example, urethane-based, polyester-based, or polyolefin-based binder can be used.

A thickness of the binder layer 2 is 2 μm or more to 150 μm or less, preferably 5 μm or more to 50 μm or less. However, the thickness depends on a size of the used abrasive grains because a part of the first abrasive grain projects from the binder layer 2. Here, in the first embodiment, the urethane-based binder was used, and the thickness of the binder was 5 μm.

<Application Process 2 (Arrangement of First Abrasive Grain): See FIG. 3A>

A mask 21 configured to mask only the surface 10*b* of the sheet 10 is disposed on the sheet 10. Thereafter, a binder is applied on the upper surfaces 10*a*1 of the convex portions 10*a* to form the binder layer 2 and a plurality of first abrasive grains 1 is applied on the binder layer 2. The first abrasive grains 1 are held by the binder layer 2, and an upper portion of the first abrasive grains are disposed to project from the binder layer 2. Thereafter, the mask 21 is removed.

Figure 3C:
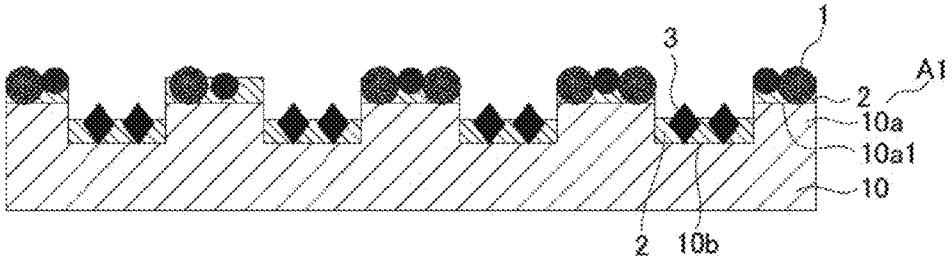
FIG. 3C is a sectional view showing the polishing sheet in which first abrasive grains and the second abrasive grains are provided on the sheet.

In a polishing sheet A1 in the first embodiment as formed in such a manner, the particulate porous bodies made of zirconia as the first abrasive grains 1 are arranged on the upper surfaces 10*a*1 of the convex portions 10*a*, as shown in FIG. 3C. Here, the alumina portions as the second abrasive grains are arranged on the surface 10*b* of the sheet 10.

<Preparation of Polishing Tool>

Figure 4:
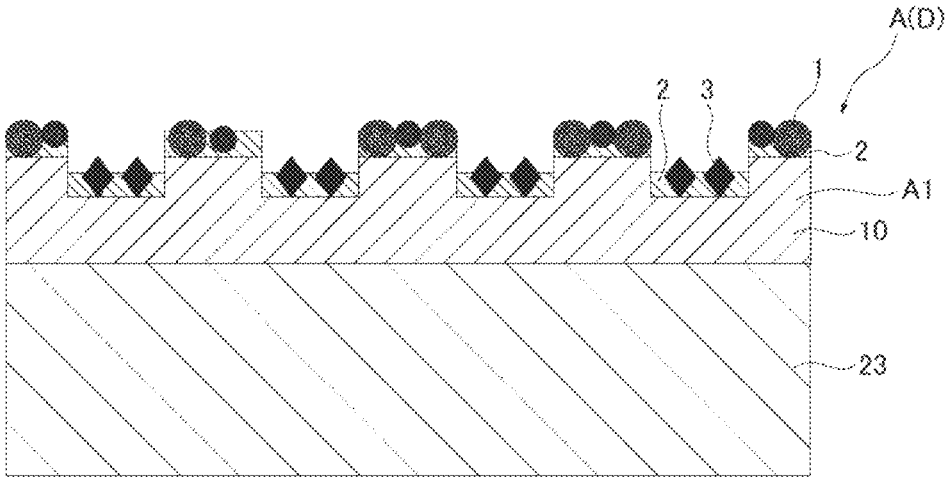
FIG. 4 is a sectional view showing a polishing tool prepared in the first embodiment.

FIG. 4 illustrates a model of a polishing tool A in the first embodiment. The polishing tool is formed by attaching a sheet-shaped backing member 23 through an adhesive to a back surface of the polishing sheet A1 formed as described above. Note that a double sided tape and so on may be used as the adhesive.

It is preferable for the backing member 23 to be a resilient body having flexibility such that contact performance of the backing member with a material to be polished is not reduced. As an example, the backing member is made of a rubber-based material such as a natural rubber, a silicone rubber or the like, or a form material such as a polyethylene form, a urethane form, or the like In addition, it is preferable that rubber hardness of the backing member 23 is less than 40 (Asker C hardness (Asker R C)). If the hardness of the backing member is too high, it is difficult to acquire a high polishing efficiency.

In the first embodiment, the polishing tool A was obtained by adhering the backing member 23 in which the hardness is 38 with the Asker C produced by Sanfuku Kogyo Co. Ltd and the thickness is 30 mm to the back surface of the polishing sheet A1.

<Supporting Experiment of Washing Effect of Water Scale>

The removal (hereinafter referred to as washing) of water scale adhered to a mirror (glass) was executed in hand work by use of the polishing tool A according to the first embodiment as prepared as described above while wetting it with water. As a result, it was possible to easily remove the water scale with a small force and a working hour became ⅓, compared to a conventional polishing tool disclosed in JP2003-105324A. In addition, it was demonstrated that a scratch, a scar or the like capable of being recognized with eyes did not occur.

Figure 5:
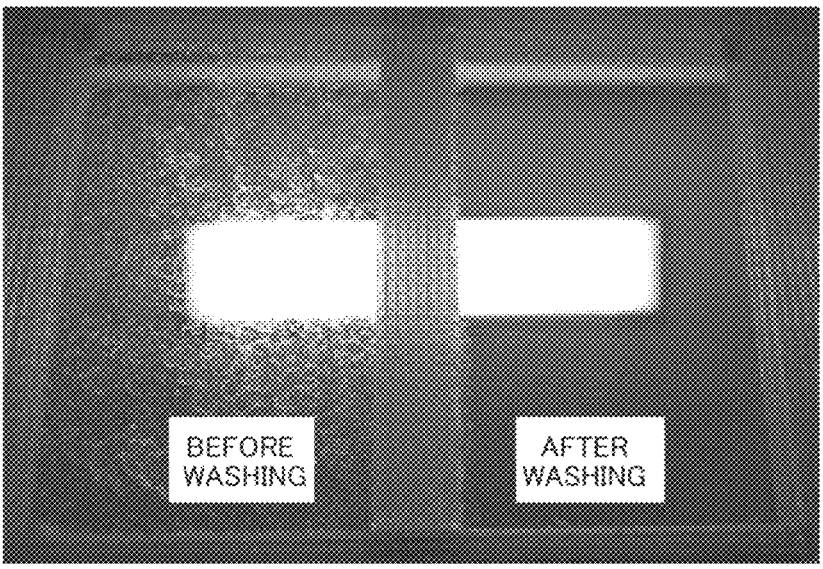
FIG. 5 is a photograph showing polishing (washing) effect by use of the polishing tool shown in FIG. 4.

FIG. 5 illustrates a photograph of a lighting fixture having a glass surface showing a state (before washing) where water scale is adhered and a state (after washing) where the water scale is removed. As is clear from FIG. 5, the water scale is removed from the glass surface after washing by use of the polishing tool according to the first embodiment, without generating the scratch or the scar.

Figure 6:
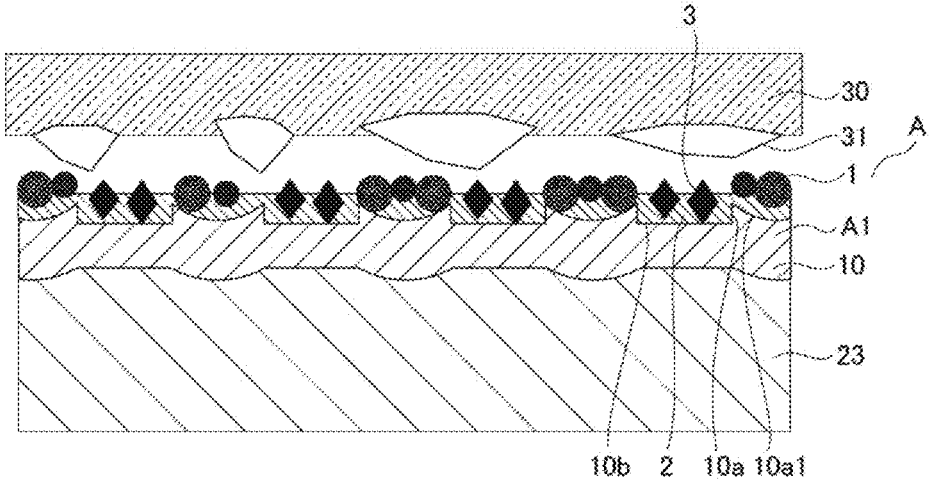
FIG. 6 is a sectional view showing one example of a mechanism of effect that improves work efficiency to remove water scale by the polishing tool shown in FIG. 4.

FIG. 6 illustrates a model of a mechanism of effect that improves work efficiency to remove the water scale obtained when using the polishing tool A according to the first embodiment.

When executing the polishing by coming in contact with the polishing tool A while pressuring with a glass 30 on which the water scale 31 is adhered, the convex portions 10*a* of the polishing tool A are pressed and resiliently deformed. FIG. 6 illustrates as a model a state where the upper surfaces 10*a*1 substantially parallel to the surface 10*b* of the sheet 10 are resiliently deformed in a concave shape. As a result of the deformation, the first abrasive grain 1 arranged on the upper surfaces 10*a*1 of the polishing tool A and the second abrasive grains 3 arranged on the surface 10*b* of the polishing tool A are simultaneously in contact with the glass 30 or the water scale 31.

At this time, the first abrasive grains 1 having hardness smaller than that of the second abrasive grains 3 and the second abrasive grains 3 having hardness higher than that of the first abrasive grains 1 are simultaneously in contact with the glass 30 or the water scale 31 to contribute to the removal of the water scale 31. In this case, the first abrasive grains 1 are in contact with the glass 30 or the water scale 31 with a high contact pressure and the second abrasive grains 3 are in contact with the glass 30 or the water scale 31 with a low contact pressure. As a result, it is possible to simultaneously obtain effect improving high polishing efficiency combining removal effect of the water scale 31 by the first abrasive grains 1 and removal effect of the water scale 31 by the second abrasive grains 3 having the hardness higher than that of the first abrasive grain, and effect preventing the occurrence of a scar or scratch.

In this way, the use of the polishing sheet according to the first embodiment makes it possible to easily remove the rigidly scaly water scale which is very hard to be removed by the conventional polishing sheet or polishing tool with a small force while reducing a possibility of damaging the mirror or the glass.

A second embodiment is described.

Figure 7:
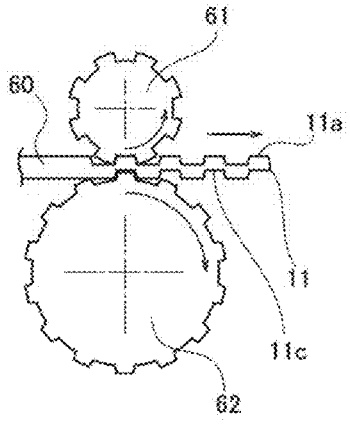
FIG. 7 is an explanatory view showing a model of a method of manufacturing a sheet (base) provided with convex portions, used in a polishing sheet according to a second embodiment of the present invention.
Figure 8:
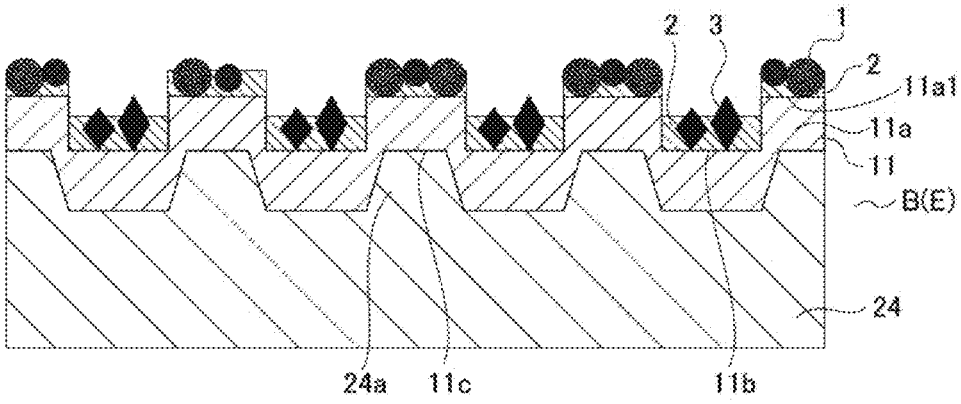
FIG. 8 is a sectional view showing a polishing tool using the sheet manufactured by the method shown in FIG. 7.

FIG. 7 illustrates as a model a method of manufacturing a sheet 11 according to the second embodiment and FIG. 8 illustrates one example of a polishing tool using the manufactured sheet as shown in FIG. 7. In the polishing tool A in the first embodiment as shown in FIG. 4, the sheet 10 in which the convex portions 10*a* are provided on the one side and the back surface is flat is used. On the other hand, in the second embodiment, the sheet 11 in which the convex portions 11*a* are provided on the one side and concave portions 11*b* are provided on the other surface to correspond to the convex portions is used.

As shown in FIG. 7, the method of manufacturing the sheet 11 uses a pair of first and second rollers 61 and 62. Each of the first roller 61 and the second roller 62 has together at a circumferential surface thereof a plurality of concave and convex portions, as shown in FIG. 7. The first roller 61 and the second roller 62 are configured to synchronously rotate to each other such that, when one convex portion of one roller, for example, the first roller 61 is in contact with one side of a raw material sheet 60, one concave portion of the other roller, the second roller 62 is disposed on the other surface of the raw material sheet 60 to face the convex portion of the first roller 61. With the these rollers 61 and 62 having the concave and convex portions, it is possible to obtain the sheet 11 as an emboss sheet in which the convex portions 11*a* are formed on the one side of the raw material sheet 60 and the concave portions 11*c* are formed on the other surface of the raw material sheet 60, and each convex portion 11*a* is disposed to correspond to each concave portion 11*c*. The second embodiment differs from the first embodiment in only the pair of first and second rollers 61 and 62 using to apply an emboss process to the raw material sheet 60. Even in the second embodiment, the same material as in the first embodiment was used for the sheet 11.

As shown in FIG. 8, a polishing tool B shown as a model in the second embodiment is similar to the polishing tool A excepting that the sheet 11 differing from the sheet 10 in structure is substituted for the sheet 10, and a backing member 24 is used instead of the backing member 23. The sheet 11 differs from the sheet 10 in structure as described above. The backing member 24 differs from the backing member 23 in that convex portions 24*a* configured to fit in the concave portions 11*c* provided in the other (back) surface of the sheet 11 are provided in the backing member 24. In the polishing tool B, the first abrasive grains 1 are disposed on upper surfaces 11*a*1 of the convex portions 11*a* and the second abrasive grains 3 are disposed on the surface 11*b*, and the first and second abrasive grains are held by the binder layer 2. An upper portion of each of the first and second abrasive grains is disposed to project from the binder layer 2.

The removal of scaly water scale adhered to a mirror or glass was executed in hand work by use of the polishing tool B while wetting it with water. As a result, it was possible to easily remove the water scale with a small force and a working hour became ⅓, compared to the conventional polishing tool, similarly to the polishing tool A. In addition, it was demonstrated that a scratch, a scar or the like capable of being recognized with eyes did not occur.

Figure 9:
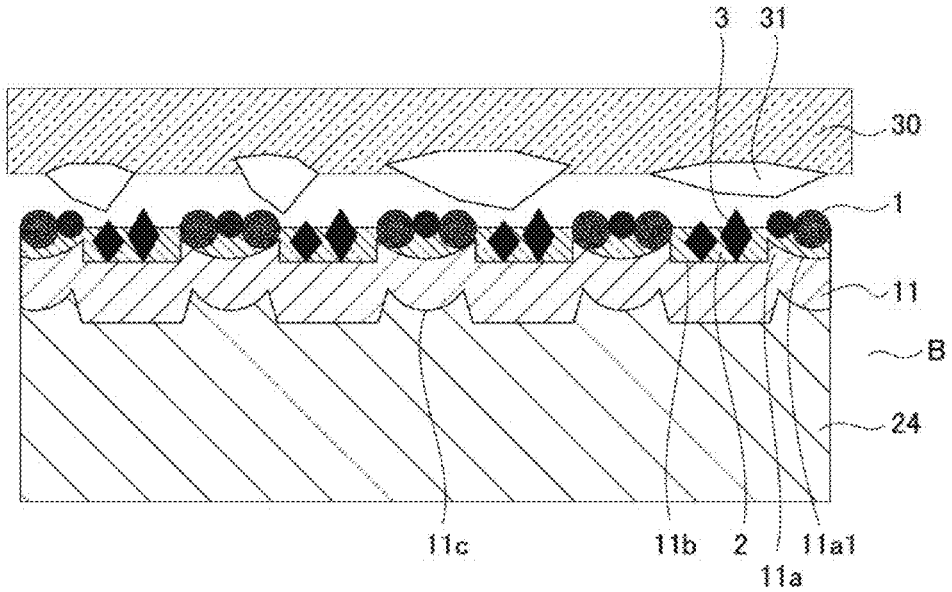
FIG. 9 is a sectional view showing one example of a mechanism of effect that improves work efficiency to remove water scale by the polishing tool shown in FIG. 8.

Even in the polishing tool B, a model of a mechanism of effect that improves work efficiency to remove the water scale is shown in FIG. 9. As shown in FIG. 9, when polishing, the convex portions 11*a* of the sheet 11 are resiliently deformed. As a result, the first abrasive grains 1 having hardness smaller than that of the second abrasive grains 3 and the second abrasive grains 3 having hardness higher than that of the first abrasive grains 1 are simultaneously in contact with the glass 30 or the water scale 31 to contribute to the removal of the water scale 31. In this case, the first abrasive grains 1 are in contact with the glass 30 or the water scale 31 with a high contact pressure and the second abrasive grains 3 are in contact with the glass 30 or the water scale 31 with a low contact pressure. Therefore, it is possible to simultaneously obtain high polishing efficiency and effect preventing the occurrence of a scar or scratch.

A third embodiment is described.

Figure 10:
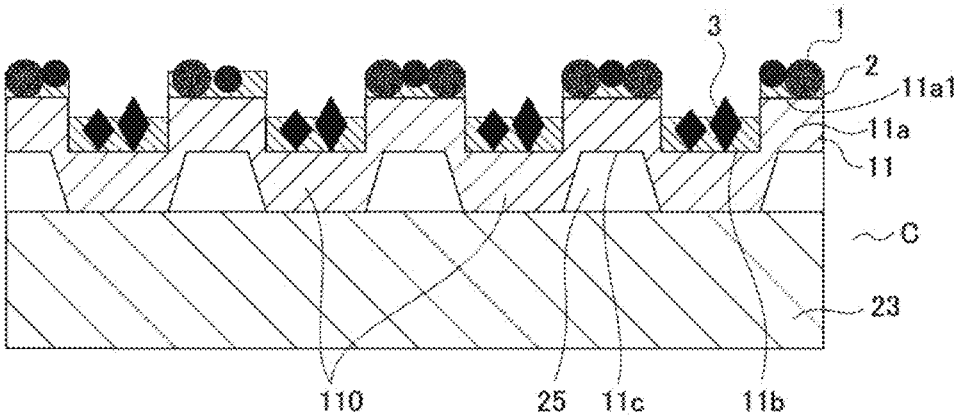
FIG. 10 is a sectional view showing one example of a polishing tool in a third embodiment of the present invention.

FIG. 10 illustrates the third embodiment. The third embodiment uses the sheet 11 as described above, similarly to the second embodiment. However, in the third embodiment, the same backing member 23 as in the first embodiment is used and a polishing tool C shown as a model in FIG. 10 is prepared. In the third embodiment, a surface of the backing member 23 facing the sheet 11 is configured to be flat (see FIG. 10). On the other hand, in the polishing tool C, a surface of the sheet 11 facing the backing member 23 has protrusions 110 formed by the concave portions 11*c* arranged at intervals so as to form spaces 25 between the sheet 11 and the backing member 23 (see FIG. 10).

The removal of scaly water scale was executed in hand work by use of the polishing tool C, similarly to the polishing tools A and B. Similarly to the cases of the polishing tools A and B, it was possible to easily remove the water scale with a small force. In addition, it was demonstrated that a scratch, a scar or the like capable of being recognized with eyes did not occur on a surface of a mirror or glass.

Here, in the polishing tool C, the spaces 25 are formed between the sheet 11 and the backing member 23, unlike the polishing tools A and B. Therefore, the convex portions 11*a* of the sheet 11 are deformed even by a smaller force than that of the polishing tool A or the polishing tool B when polishing. As a result, it is possible to easily acquire effect removing the water scale by the second abrasive grain, compared to the polishing tool and the polishing tool B.

Figure 11:
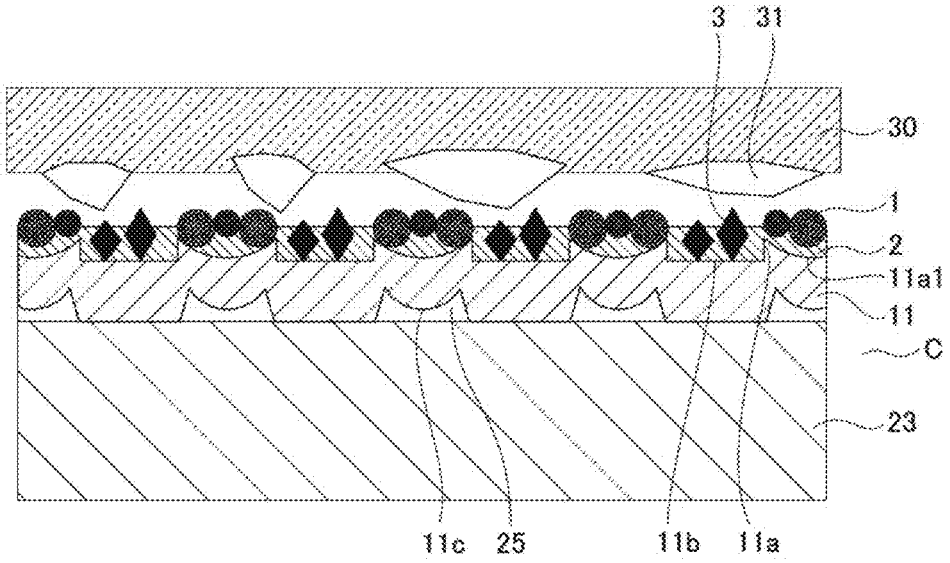
FIG. 11 is a sectional view showing one example of a mechanism of effect that improves work efficiency to remove water scale by the polishing tool shown in FIG. 10.
Figure 12:
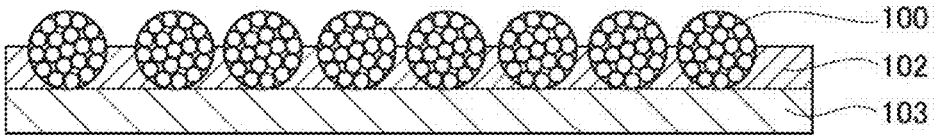
FIG.12 (PRIOR ART)
FIG. 12 is a sectional view showing one example of a conventional polishing tool.

Even in the polishing tool C, a model of a mechanism of effect that improves work efficiency to remove the water scale is shown in FIG. 11. As shown in FIG. 11, when polishing, the convex portions 11*a* of the sheet 11 are resiliently deformed. As a result, the first abrasive grains 1 having hardness smaller than that of the second abrasive grains 3 and the second abrasive grains 3 having hardness higher than that of the first abrasive grains 1 are simultaneously in contact with the glass 30 or the water scale 31 to contribute to the removal of the water scale 31. In this case, the first abrasive grains 1 are in contact with the glass 30 or the water scale 31 with a high contact pressure and the second abrasive grains 3 are in contact with the glass 30 or the water scale 31 with a low contact pressure. Therefore, it is possible to simultaneously obtain high polishing efficiency and effect preventing the occurrence of a scar or scratch.

A fourth embodiment is described.

(Case 1: Example of Using Abrasive Grain Formed by Ceramic Sintering Body)

A polishing tool D similar to the polishing tool A was prepared (see FIG. 4). However, particles obtained by crushing a sintered body of silicon carbide are used as the second abrasive grains, instead of the crushed alumina. At this time, it was demonstrated that a number average diameter of the second abrasive grains had 10 μm and the maximum diameter of the second abrasive grains had 18 μm. In addition, it was confirmed that, when hardness of the crushed sintered body of silicon carbide was compared with the hardness of the particulate porous bodies of the first abrasive grains, the hardness of the crushed sintered body of silicon carbide was higher than the hardness of the particulate porous body of the first abrasive grains. The removal of scaly water scale was executed in hand work by use of the polishing tool. Similarly to the case of the polishing tool A, it was possible to easily remove the water scale with a small force. In addition, it was demonstrated that a scratch, a scar or the like capable of being recognized with eyes did not occur on a surface of a mirror or glass.

(Case 2: Example of Using Abrasive Grain Formed by Ceramic Sintered Body)

A polishing tool E similar to the polishing tool B was prepared (see FIG. 8). However, particles obtained by crushing a sintered body of zirconia alumina are used as the second abrasive grains, instead of the crushed alumina. At this time, it was demonstrated that a number average diameter of the second abrasive grains had 20 μm and the maximum diameter of the second abrasive grains had 30 μm. In addition, it was confirmed that, when hardness of the crushed sintered body of zirconia alumina was compared with the hardness of the particulate porous body of the first abrasive grains, the hardness of the crushed sintered body of zirconia alumina was higher than the hardness of the particulate porous body of the first abrasive grains. The removal of scaly water scale was executed in hand work by use of the polishing tool. Similarly to the case of the polishing tool B, it was possible to easily remove the water scale with a small force. In addition, it was demonstrated that a scratch, a scar or the like capable of being recognized with eyes did not occur on a surface of a mirror or glass.

It should be noted that the polishing sheet, the polishing tool, and the polishing method according to the present invention may be used for anything except the mirror or glass described in the first to fourth embodiments.

According to the foregoing polishing sheet described in each of the above-mentioned embodiments, the first abrasive grains and the second abrasive grains having the higher hardness than that of the first abrasive grains can be contributed to polish an object to be polished by a structure in which the first abrasive grains are arranged on the convex portions provided to project from the one side of the sheet and the second abrasive grains are arranged on the one side of the sheet. The first abrasive grains are in contact with the object with a relatively large force and the second abrasive grains are in contact with the object with a relatively small force. As a result of such a structure, it is possible to securely and rapidly remove water scale and so on without damaging the object by polishing efficiency of the first abrasive grains that does not damage a polished surface of the object and polishing efficiency of the second abrasive grains that securely removes the water scale and so on.

Although the several embodiments of the present invention have been described, it should be noted that the polishing sheet, the polishing tool, and the polishing method according to the present invention are not limited to these embodiments, and various modifications and changes can be made to the embodiments by those skilled in the art as long as such modifications and changes are within the scope of the present invention as defined by the Claims.

What is claimed is:

1. A polishing sheet comprising:

a sheet including one side having an upper surface;

a plurality of concave portions formed in the upper surface of the one side of the sheet;

a plurality of first abrasive grains provided on or in the upper surface of the sheet; and a plurality of second abrasive grains provided on or in each of the concave portions, the plurality of second abrasive grains each having hardness higher than that of the plurality of first abrasive grains.

2. The polishing sheet according to claim 1, wherein each of the plurality of first abrasive grains is composed of a particulate porous body in which primary particles are partially combined with each other, the partially combined primary particles having gaps therebetween, and each of the plurality of second abrasive grains is composed of a ceramic sintered body.

3. The polishing sheet according to claim 1, wherein a binder layer is disposed between the upper surface of the sheet and the plurality of first abrasive grains and between the concave portions and the plurality of second abrasive grains.

4. The polishing sheet according to claim 1, wherein an other side the sheet includes concave portions formed at positions corresponding to portions of the one side of the sheet in which the plurality of concave portions are not formed.

5. A polishing tool comprising:

the polishing sheet claimed in claim 1; and a backing member disposed on an other side of the sheet having Asker C hardness less than 40.

6. A polishing method comprising:

executing polishing work by using the polishing sheet claimed in claim 1 or the polishing tool claimed in claim 5.

7. The polishing sheet according to claim 1, further comprising a binder layer, the first abrasive grains being disposed in the binder layer, and a part of the first abrasive grains protruding from the binder layer.

8. The polishing sheet according to claim 7, wherein the second abrasive grains are disposed in the binder layer, and a part of the second abrasive grains protrudes from the binder layer.

* * * * *